US005558209A

United States Patent [19]

Mohsen

[11] Patent Number: 5,558,209

[45] Date of Patent: Sep. 24, 1996

[54] LOCKOUT FOR CONVENTIONAL WALL-TYPE TOGGLE OR ROCKER ELECTRICAL SWITCH ASSEMBLIES

[76] Inventor: Jafar Mohsen, 409 Honker La., Suisun City, Calif. 94585

[21] Appl. No.: 397,586

[22] Filed: Mar. 2, 1995

Related U.S. Application Data

[63] Continuation-in-part of Ser. No. 231,023, Apr. 21, 1994, Pat. No. 5,468,925.

[51] Int. Cl.[6] ..... H01H 9/28

[52] U.S. Cl. ..... 200/43.22; 200/43.16; 200/43.11

[58] Field of Search ..... 200/43.22, 43.01, 200/43.11, 43.13, 43.14, 43.15, 43.16, 43.18, 43.19, 43.21, 331, 330, 329

[56] References Cited

U.S. PATENT DOCUMENTS 1,168,066 11/1916 Girardot ..... 200/43.22
5,260,528 11/1993 Benda ..... 200/43.22

*Primary Examiner*—David J. Walczak
*Attorney, Agent, or Firm*—Harold D. Messner

[57] ABSTRACT

A switch lockout for preventing movement of a switch arm which projects through an opening in a switch face plate and pivots about a transverse ON-OFF axis, of either a conventional wall-type electrical rocker or a conventional wall-type toggle switch, comprises (i) a mounting frame parallel to the switch face plate that includes a side wall of octagonal shape integrally attached to a planar end wall located—in operations—in a position parallel to the switch face plate. The end wall has a continuous edge integrally attached to the side wall to form a box-like interior cavity, and a central aperture extending orthogonally therethrough, and (ii) a cover frame pivotally attached to the mounting frame along a transverse pivot axis parallel to the transverse ON-OFF axis of the switch arm. The cover frame includes a side wall of octagonal shape integrally attached to an end wall that is bulbously shaped in its mid-region to define separate up-ramp and down-ramp segments that attach between co-planar first and second end segments. In operations, either the counterbore segment of the mounting frame or the up-ramp segment of the cover frame are used to create "stops" when the cover frame is placed in a closed state relative to the mounting frame, such "stops" limiting movement of the switch arm irrespective of type of switch assembly used, and irrespective of the ON-OFF operative state of the switch arm.

20 Claims, 4 Drawing Sheets

LOCKOUT FOR CONVENTIONAL WALL-TYPE TOGGLE OR ROCKER ELECTRICAL SWITCH ASSEMBLIES

CROSS-REFERENCE TO RELATED APPLICATIONS

This is a continuation-in-part of Ser. No. 08/231,023 filed 21 Apr. 1994 for ENCLOSURE FOR AN ELECTRICAL SWITCH now U.S. Pat. No. 5,468,925 which as related to my prior application, Ser. No. 08/073,130 filed Jun. 7, 1993 now abandoned.

SCOPE OF THE INVENTION

The present invention relates to a lockout for electrical switch assemblies and more particularly to such a lockout associated with a conventional wall-type toggle or rocker switch in which mounting and cover frames of the invention are attached to parallel relationship relative to a conventional switch face plate parallel to an end plate of a conventional switch assembly so as to provide both a locked ON or a locked OFF operating state for the switch arm of the switch assembly.

In one aspect, the mounting frame is fixedly mounted relative to the switch face plate, and is also pivotally attached relative to the cover frame of the invention via a transverse pivot axis parallel to the ON-OFF traverse pivot axis of the switch arm. In such aspect, the mounting frame includes an octagonally shaped side wall that is integrally attached to a transversely extending planar end wall having a large central aperture positioned in fixed position relative to the switch arm. The rear surface of the end wall also includes a counterbore segment contiguous to a transverse edge of the aperture defining a receiving cavity of rectangular cross section sized to adjacently accept at least ⅓ of a switch arm when used in association with a rocker switch.

In another aspect of the present invention, the cover frame includes an octagonally shaped side wall that is integrally attached to a transversely extending end wall that includes an up ramp segment and a down ramp segment over its mid-portion section that attaches between co-planar first and second end segments, the latter defining a common transverse bisecting plane that also intersects the transverse pivot axis. The up-ramp segment defines an included angle A relative to the common transverse bisecting plane and a terminating apex segment. The down tramp segment is connected between the apex segment and the second end segment. In operations, either the counterbore segment of the mounting frame or the up-ramp segment of the cover frame are used to create "stops" when the cover frame is placed in a closed state relative to the mounting frame, such "stops" limiting movement of the switch arm irrespective of type of switch assembly used, e.g., toggle or rocker style, and irrespective of the ON-OFF operative state of the switch arm.

BACKGROUND OF THE INVENTION

Devices for locking switches in one of two ON-OFF operative states or "lockout" position, are well-known. While the prior art is replete with devices associated with locking down the elongated switch arms of toggle type switches, none of which I am aware, can be made to also operate in conjunction with rocker-style wall switch assemblies and in either one of the ON-OFF operating state of the switch assembly. I.e., experience has shown a need for a universally useable lockout device for association with either a rocker style or toggle type switch as used in walls of homes, businesses or the like for use in either a lock ON or lock OFF operating state.

DEFINITIONS

A toggle switch for wall attachment in a home, business or the like includes a box-like support structure usually attached to a upright wall stud into which a switch assembly is mounted. The switch assembly includes a housing, a planar side wall member attached to both the housing and to the support structure and a switch arm, the planar side wall member including a pair of threaded openings to accept mounting screws for a conventional planar face plate attachable in parallel relationship with respect to the planar side wall member. The switch arm pivotally attaches to the housing along a transverse pivot axis and is pivotal about the pivot axis wherein the arm establish separate ON and OFF states for the switch assembly each about 66 degrees from a longitudinal plane parallel to the switch face plate. During rotational movement of the switch arm, its rectangular cross section tip extends through aligned openings in the planar side wall member and the conventional face plate.

A rocker switch for wall attachment in a home, business or the like includes a box-like support structure usually attached to a upright wall stud into which a switch assembly is mounted. The switch assembly includes a housing, a planar side wall member attached to both the housing and to the support structure and a switch arm, the planar side wall member including a pair of threaded openings to accept mounting screws for a conventional planar face plate attachable in parallel relationship with respect to the planar side wall member. The switch arm includes an angled surface positioned almost parallel to the switch face plate but convexly oriented thereto and having end surfaces that rise or fall relative thereto via teeter totter movement of the arm about along a centrally disposed transverse pivot axis. In that way, up-slope or down-slope orientation of the angled surface is indicative the ON or OFF state of the switch wherein the culmination of the either the up or down movement of the end surfaces of the switch arm cause the arm to teeter about the pivot axis to establish an separate ON and OFF state of the switch. Note that both up-slope and down slope segments of the angled surface of the switch arm extend beyond the surface of the conventional face plate.

SUMMARY OF THE INVENTION

The present invention relates a switch lockout for preventing movement of a switch arm of either a conventional wall-type electrical rocker switch or a convention wall-type toggle switch. Note that with use with either switch, a switch arm is provided which projects through an opening in a switch face plate and pivots about a transverse ON-OFF axis to provide separate ON-OFF operating states. The lockout of the invention comprises the following:

(i) a mounting frame to be attached in parallel relationship relative to the switch face plate and including a side wall of octagonal shape integrally attached to a planar end wall located—in operations—in a position parallel to the switch face plate. The end wall has a continuous edge integrally attached to the side wall to form a box-like structure, as well as the following: (a) a central aperture extending orthogonally therethrough, (b) a trio of longitudinally spaced orthogonally extending openings for attachment purposes relative to the switch wherein a pair of the latter are alignable with the first and second openings of the switch face plate irrespective of switch type, and (c) counterbore segment provided at the rear surface of the end wall that is contiguous to a transverse edge of the aperture and defines a receiving cavity of rectangular cross section sized to adjacently accept at least ⅓ of a switch arm when used in association with a rocker switch, and (ii) a cover frame pivotally attached to the mounting frame along a transverse pivot axis parallel to the transverse ON-OFF axis of the switch arm. The cover frame includes a side wall of octagonal shape integrally attached to an end wall that is bulbously shaped in its mid-region to define separate up-ramp and down-ramp segments that attach between co-planar first and second end segments. The up-ramp segment terminates at an apex segment and defines an included angle A relative to a transverse working plane of about 66 degrees that is matched to the angle of the switch arm of a toggle switch in either its ON or OFF position. In operations, either the counterbore segment of the mounting frame or the up-ramp segment of the cover frame are used to create "stops" when the cover frame is placed in a closed state relative to the mounting frame, such "stops" limiting movement of the switch arm irrespective of type of switch assembly used, e.g., toggle or rocker style, and irrespective of the ON-OFF operative state of the switch arm.

The interior, forward surface of the planar end wall of the mounting frame also include a hasp that cantilevers therefrom in a location that is alignable with and extends through a slot in the end wall of the cover frame when the latter is closed relative to the mounting frame. Thus in the closed state of the cover frame, a padlock can be inserted through an opening in the hasp to lock the cover frame relative to the mounting frame.

DETAILED DESCRIPTION OF EMBODIMENTS OF THE INVENTION

Figure 1:
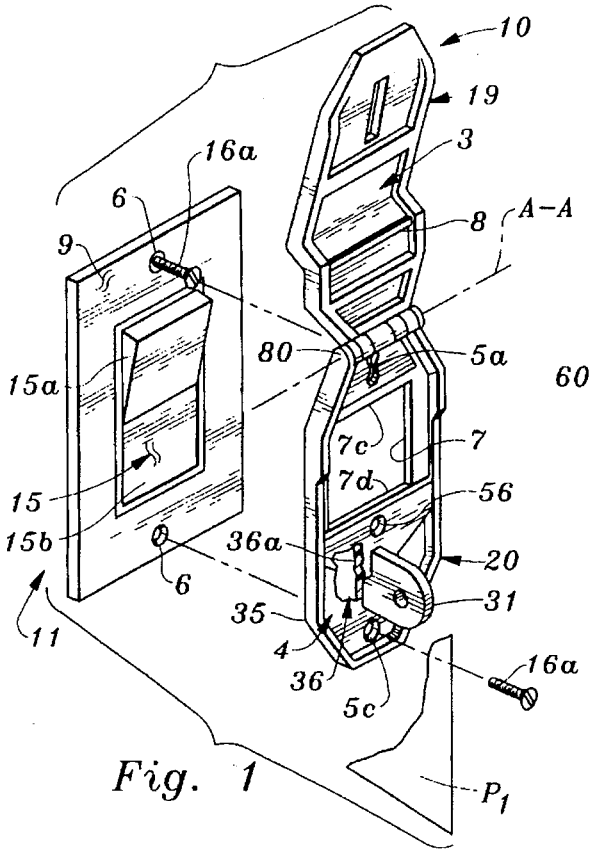
FIG. 1 is a perspective, exploded view of the switch lockout of the present invention in association with a rocker switch attached via mounting screws to a conventional switch face plate at an upright wall for "locking out" the rocker switch in its OFF state and illustrating the cover and mounting frames of the lockout in an open position relative to each other.
Figure 3:
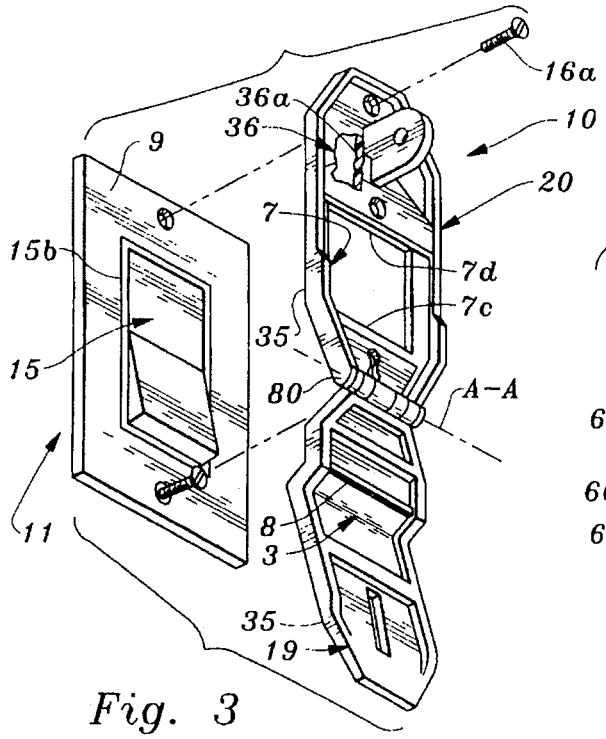
FIG. 3 is a perspective, exploded view of the switch lockout of the present invention in association with the rocker switch of FIG. 1 except that the lockout of the invention attached via mounting screws to a conventional switch face plate at an upright wall, "locks out" the rocker switch in its ON operating state.

Referring to FIGS. 1 and 3, switch lockout 10 of the present invention is shown in association with a conventional rocker switch generally indicated at 11. In FIG. 1, the lockout 10 is in position to be attached to face plate 9 to preserve the OFF operating state of rocker switch 11 in a "lock out" position. In FIG. 3, the lockout 10 is in position to be attached to face plate 9 to preserve the ON operating state of rocker switch 11 in a "lock out" position. Before the lockout 10 of the invention is described, a brief explanation of the rocker switch 11 is believed to be in order and is set forth below.

Figure 11:
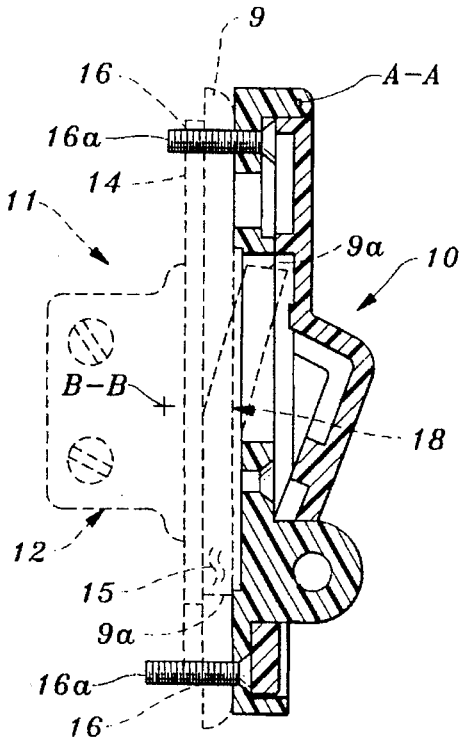
FIG. 11 is another section akin to FIG. 9 in which the lockout is attached to the rocker switch of FIG. 1 to "lock out" such switch in its OFF operating state, such rocker switch being shown in phantom line.
Figure 10:
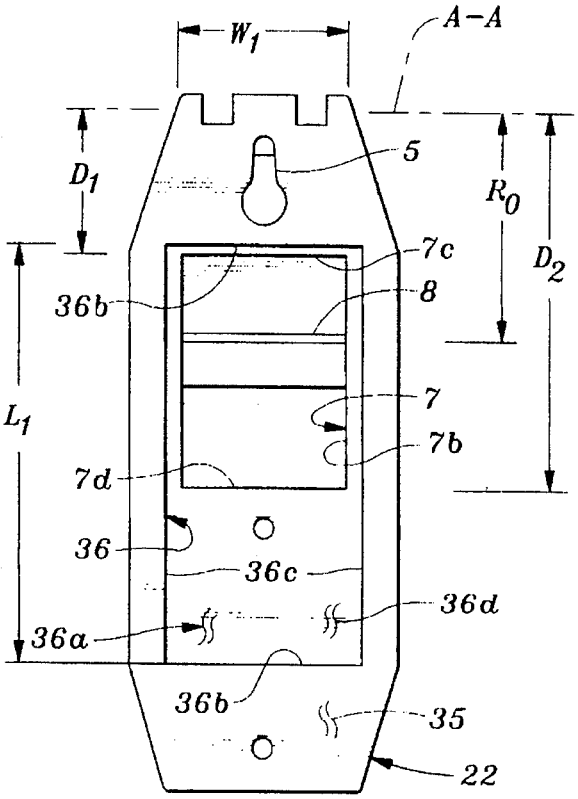
FIG. 10 is a rear elevation of the lockout of FIG. 7.
Figure 7:
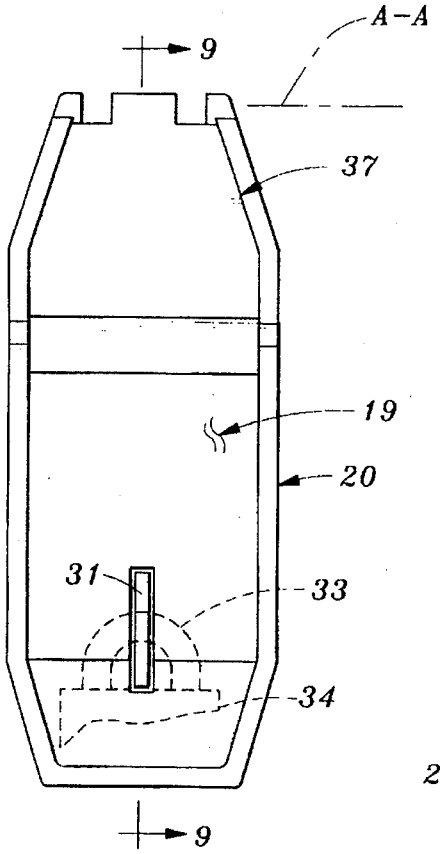
FIG. 7 is another top elevation of the lockout of the invention in which cover frame has been pivoted about a transverse axis to assume an fully closed position relative to the mounting frame of the lockout.
Figure 9:
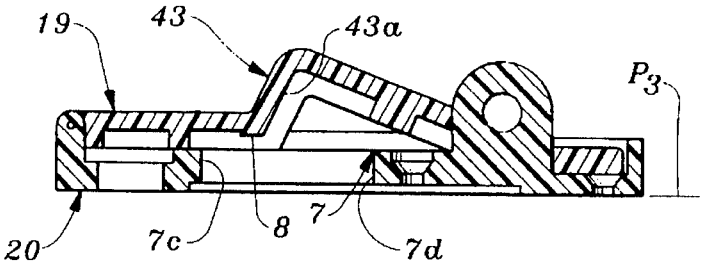
FIG. 9 is a section taken along line 9—9 of FIG. 7.
Figure 12:
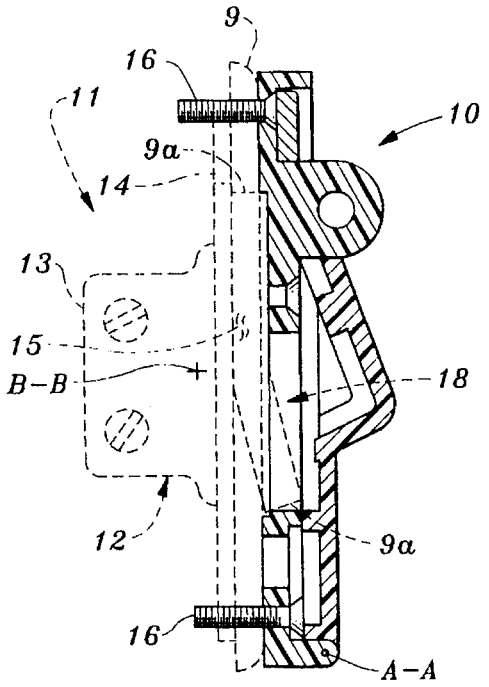
FIG. 12 is still another section akin to FIG. 9 in which the lockout is attached to the rocker switch of FIG. 3 to "lock out" such switch in its ON operating state wherein the switch is shown in phantom line.

As explained in association with FIG. 11 and 12, the rocker switch 11 includes switch assembly 12 comprising a housing 13, a planar side wall member 14 attached to the housing 13 and an angled, longitudinally extending switch arm 15. The planar side wall member 14 includes a pair of threaded openings 16 to accept a pair of mounting screws **16*a* for attaching the switch lockout 10 of the invention along with conventional planar face plate 9 relative to the planar side wall member 14. The switch arm 15 includes an angled surface 18 positioned almost parallel to the switch face plate 9 but convexly oriented thereto and having end surfaces 9***a* that rise or fall relative thereto via teeter totter movement of the arm 15 about a centrally disposed transverse pivot axis B—B. In that way, up-slope or down-slope orientation of the angled surface 18 of the switch arm 15 indicative the ON or OFF state of the rocker switch 11 wherein the culmination of the either the up or down movement of the end surfaces 9*a* cause the arm 15 to teeter about the pivot axis B—B to establish the OFF state of operation as shown in FIG. 1 or to establish the ON state of operation as shown in FIG. 3. Note that portions of both up-slope and down slope segments of the angled surface 18 of the switch arm 15 extend beyond the conventional face plate 9.

Returning to FIG. 1, note that the lockout 10 of the invention is shown in its open position wherein cover frame 19 has been pivoted about transverse pivot axis A—A relative to mounting frame 20 to expose respective interior cavities 3, 4. With regard to the interior cavity 4 of the mounting frame 20, a trio of orthogonally extending openings 5*a*, 5*b* and 5*c* are shown, wherein openings 5*a* and 5*c* are alignable with openings 6 in the switch face plate 9. The opening 5*a* is longitudinally slotted so that the mounting screw 16*a* associated therewith, need not be fully removed. The opening 5*c* is not slotted. Hence the mounting screw 16*a* associated therewith, must be fully removed from the face plate 9 before attachment, as shown. The interior cavity 4 of the mounting frame 20 also includes a central aperture 7 engineered to permit up-slope segment 15*a* of the arm 15 to penetrate therethrough after the mounting frame 20 is attached via the mounting screws 16*a* as shown in FIG. 11. However, after the cover frame 19 has been pivoted downwardly as shown into nesting contact with the mounting frame 20 as explained below, note that down-slope segment 15*b* of the switch arm 15 will be placed adjacent to and be received within counterbore segment 36 provided at rear surface 35 of the mounting frame 20 that is contiguous to a transverse edge 7*d* of the aperture 7 and defines a receiving cavity 36*a* of rectangular cross section sized to adjacently accept the down-slope segment 15*b* of the switch arm 15 of the rocker switch 11. In such location, as explained below, the receiving cavity 36*a* of the counterbore segment 36 forms a "stop" so that the rocker switch 11 is "locked out" as to further pivotal switching movement. Hence the OFF operating state of the rocker switch 11 is preserved.

In similar fashion with regard to FIG. 3, the ON operating state of the rocker switch 11 can be preserved. Note that the orientation of the lockout 10 is reversed—head—to—toe—from that depicted in FIG. 1. That is, the pivot axis A—A is now located at the lower half of the face plate 9 and the cover frame 19 is pivoted in a upward direction to affect closure relative to the mounting frame 20. In such position, note that down-slope segment 15*b* of the switch arm 15 will be placed adjacent to and be received within counterbore segment 36 provided at rear surface 35 of the mounting frame 20 that is contiguous to a transverse edge 7*d* of the aperture 7 and defines a receiving cavity 36*a* of rectangular cross section sized to adjacently accept the down-slope segment 15*b* of the switch arm 15 of the rocker switch 11. In such location, as explained below, the receiving cavity 36*a* of the counterbore segment 36 forms a "stop" so that the rocker switch 11 is "locked out" as to further pivotal switching movement. Hence the ON operating state of the rocker switch 11 is preserved.

Further details of the lockout 10 are shown in FIGS. 5–10. The mounting frame 20 of the lockout 10 of the invention is integrally formed and attaches to the cover frame 19 at pivot axis A—A. It comprises an octagonally shaped side wall 21 divided into a series of contiguous side segments 21*a* and a planar-like end wall 22. The end wall 22 having a continuous circumferentially extending edge in integral contact with the octagonal side wall 21 to form the box-like cavity 4 previously mentioned. The planar end wall 22 is also provided with large central aperture 7 also previously mentioned, over a central segment 25, the central aperture 7 being defined by an orthogonally extending axis of symmetry 26, see FIG. 6. The trio of orthogonally extending openings 5*a*, 5*b* and 5*c* are also provided through the end wall 22 in which two of the trio of openings 5*a*, 5*c* or 5*a*, 5*b*, are used to accept the mounting screws 16*a* of FIGS. 1 and 3. The opening 5*a* is provided in a longitudinally extending slot 27 and is longitudinally positioned within the cavity 4 at end segment 28 of the end wall 22; the opening 5*b* is provided in a thicken mid-portion segment 29 of the end wall 22; and the opening 5*c* is provided at a remote end segment 30 of the end wall 22. An upright hasp 31 is positioned between the mid-portion and remote end segments 29, 30 and is provided with an opening 32, see FIG. 6, to accept the bail 33 of a padlock 34, see FIGS. 7 and 8, to secure cover frame 19 relative to the mounting frame 20 in their closed working condition. In FIG. 1, a longitudinally extending working plane P1 is seen to bisect the hasp 31 as well as being perpendicular to the transverse pivot axis A—A.

Returning to FIG. 5, note that the aperture 7 of the end wall 22 is rectangular in cross section, and is provided (i) with longitudinal edges 7*a*, 7*b* and transverse edges 7*c*, 7*d*, (ii) at exterior surface 35 of the end wall 22, is also continuous with counterbore segment 36 provided at the rear surface 35 of the mounting frame 22, the latter defining a receiving cavity 36*a* of rectangular cross section. Note in FIG. 10 that receiving cavity 36*a* of the counterbore segment 36 includes transverse edges 36*b* and longitudinal edges 36*c*. The longitudinal edges 36*c* define a width W1 and the transverse edges 36*b* define a length L1. The transverse edges 36*b* are offset from the transverse pivot axis A—A, while the transverse edge 7*c* of the aperture 7 is located nearest to the transverse pivot axis A—A and defines a longitudinal distance D1 therefrom. The second transverse edge 7*d* is positioned most remote from the transverse pivot axis A—A at a fixed longitudinal distance D2 wherein D2>D1.

As shown in FIGS. 11 and 12, the transverse pivot axis A—A of the cover frame 19 relative to mounting frame 20 is seen to be parallel to the transverse ON-OFF axis B—B of the rocker switch 11. As indicated in FIG. 1, such pivot axis A—A is also seen to be normal to and intersecting the longitudinally extending working plane P1 which bisects the hasp 31. As a result, the cover frame 19 is permitted to undergo rotation relative to the pivot axis A—A into one of a closed or open operating state relative to the mounting frame 20.

The cover frame 19 will now be described in detail with reference to FIGS. 5–9.

Figure 5:
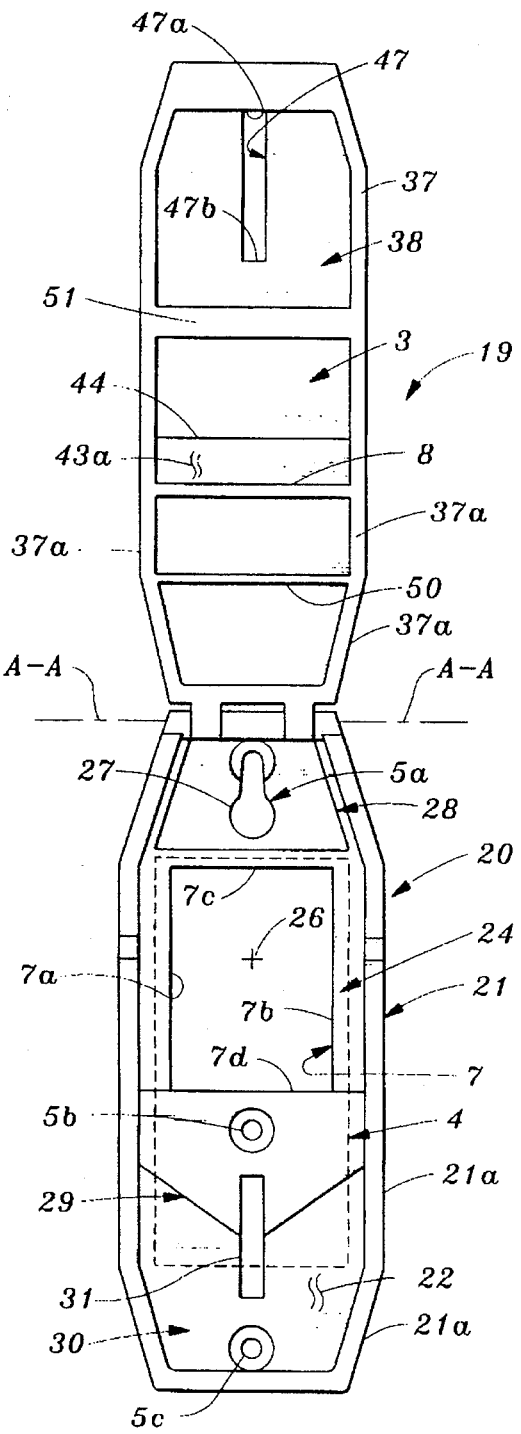
FIG. 5 is a top elevation of the lockout of FIGS. 1–4 detached from use with the rocker and toggle switch in its open position whereby the cover frame has been pivoted about a transverse axis to assume an fully open position relative to the mounting frame of the lockout.

As shown in FIG. 5, the cover frame 19 comprises side wall 37 of octagonal shape including a series of side segments 37*a* and an end wall 38 having a continuous edge integrally attached to the side wall 37 to form the box-like interior cavity 3 previously mentioned. As shown best in FIGS. 7 and 8, the side walls 37 of the cover frame 19 are shaped to fit within the confines of the mounting plate 20 over a substantial portion thereof when defining the closed operating state of the invention. Returning to FIG. 6, the end wall 38 includes first and second end segments 40, 41 and a mid-portion segment 42 positioned between the first and second end segments 40, 41. In such view, the mid-portion 42 is bulbously formed and includes an up-ramp segment 43 that connects to the first end segment 40 at a longitudinally position relative to the transverse pivot axis A—A that defines a maximum radius of rotation Ro therefrom. The up-ramp segment 43 has an interior planar surface 43*a* also defined by an included angle A relative to a second transversely extending working plane P3 that bisects the first and second end segments 40, 41. The up-ramp segment 43 terminates in apex segment 44. The apex segment 44 defines a maximum radius of rotation R1 relative to the transverse pivot axis A—A. Further, in side view, the mid-portion 42 also includes a down-ramp segment 45. The down-ramp segment 45 is seen to integrally connected to the apex segment 44 and to the second end segment 41 at a location defined by a maximum radius of rotation R2. A slot 47 is seen to be defined in the end wall 38 and has ends 47*a*, 47*b* wherein end 47*a* is in the down-ramp segment 45 and end 47*b* is in the second end segment 41. In the closed position of the cover frame 19, the slot 47 receives the hasp 31 of the mounting frame 20.

Along the interior cavity 3 of the cover frame 19 is a series of cross members 8, 50, 51 for structural integrity. Note that the cross members 8, 51 and 52 are integrally connected at their ends to the side wall 37 and are longitudinally spaced relative to the pivot axis A—A.

For example, in the first end segment 40 the cross members 50 and 8 are longitudinally positioned relative to the transverse pivot axis A—A so that the following occur: (i) the cross member 8 defines a maximum radius of rotation Ro, and (ii) the cross member 50 also being pivotally rotatable in association with transverse pivot axis A—A so as to define a maximum radius of rotation R4 wherein R4<RO<R1<R2 normalized relative to the transverse pivot axis A—A. In addition, note in FIG. 10 that D2>Ro>D1 and D1=R4. Hence the cross member 8 is strategically positioned for stability purposes.

Figure 2:
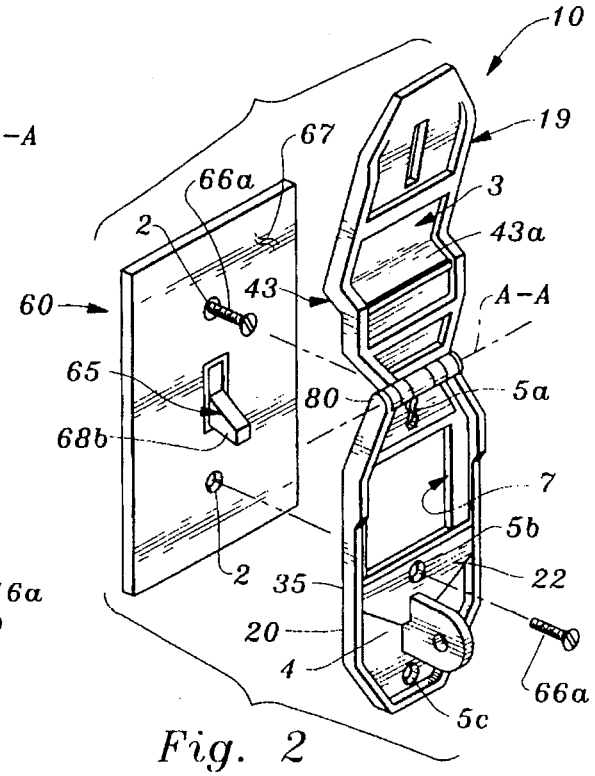
FIG. 2 is a perspective, exploded view of the switch lockout of the present invention in association with a toggle switch attached via mounting screws to a conventional switch face plate at an upright wall for "locking out" the toggle switch in its OFF state and illustrating the cover and mounting frames of the lockout in an open position relative to each other.
Figure 4:
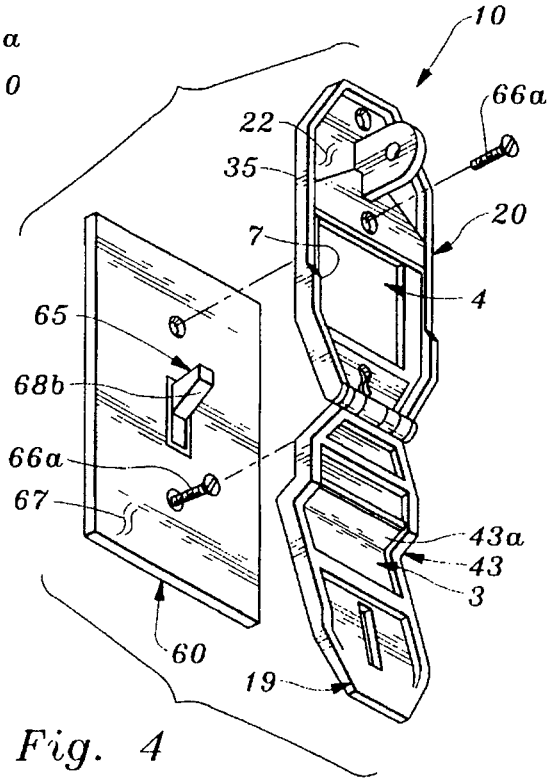
FIG. 4 is a perspective, exploded view of the switch lockout of the present invention in association with the toggle switch of FIG. 2 except that the lockout of the invention attached via mounting screws to a conventional switch face plate at an upright wall, "locks out" the toggle switch in its ON operating state.

Referring to FIGS. 2 and 4, switch lockout 10 of the present invention is shown in association with a conventional toggle switch generally indicated at 60. In FIG. 2, the lockout 10 is in position to be attached to face plate 67 to preserve the OFF operating state of toggle switch 60 in a "lock out" position. In FIG. 4, the lockout 10 is in position to be attached to face plate 67 to preserve the ON operating state of the toggle switch 60 in a "lock out" position. Before the lockout 10 of the invention is described, a brief explanation of the toggle switch 60 is believed to be in order and is set forth below.

Figure 13:
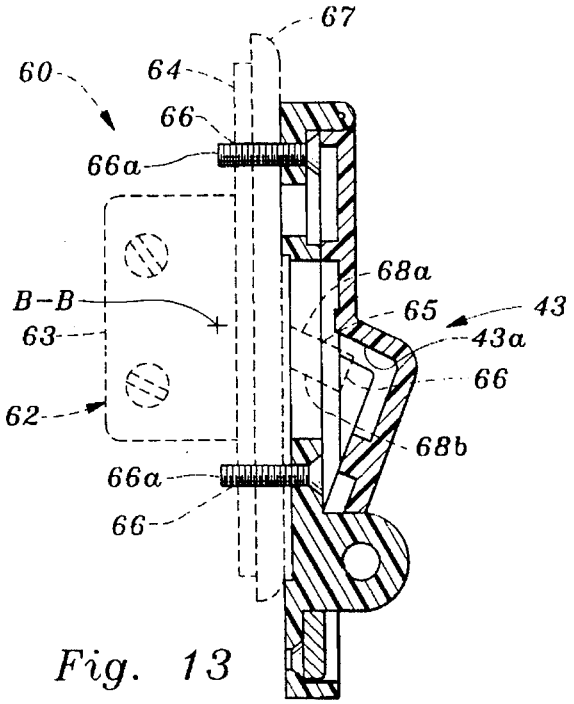
FIG. 13 is yet another section akin to FIG. 9 in which the lockout is attached to the toggle switch of FIG. 2 to "lock out" such switch in its OFF operating state wherein toggle switch is shown in phantom line.
Figure 8:
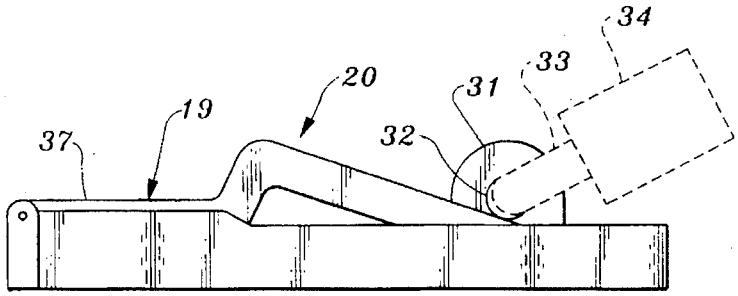
FIG. 8 is a side elevation of the lockout of FIG. 7.
Figure 14:
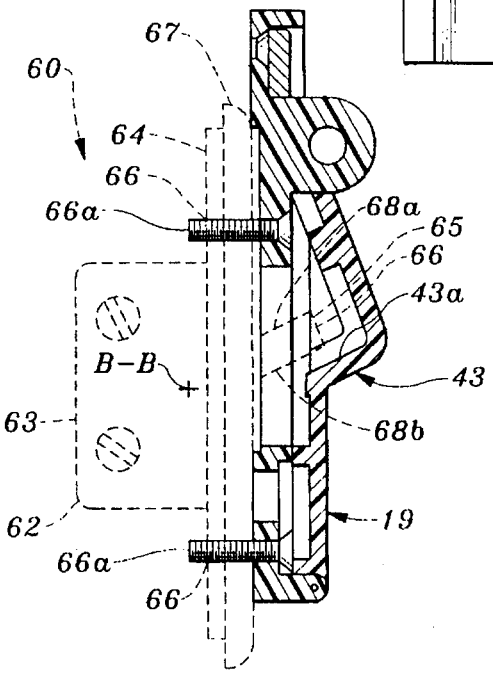
FIG. 14 is still another section akin to FIG. 9 in which the lockout is attached to the toggle switch of FIG. 4 to "lock out" such switch in its ON operating state in which such switch is shown in phantom line.

As seen in FIGS. 13 and 14, the toggle switch 60 includes switch assembly 62 comprising a housing 63, a planar side wall member 64 attached to the housing 63 and an orthogonally extending switch arm 65. The planar side wall member 64 includes a pair of threaded openings 66 to accept a pair of mounting screws 66*a* for attaching the switch lockout 10 of the invention along with conventional planar face plate 67 relative to the planar side wall member 64. The switch arm 65 of rectangular cross section includes parallel angled surfaces 68*a* and 68*b* defining a common included angle equal to angle A for the up-slope surface 43*a* of the up-slope segment 43 of the cover frame 19. The switch arm 65 pivotally attaches to the housing 63 at ON-OFF transverse pivot axis B—B. In that way, the arm 65 moves about an included angle of about 66 degrees to establish separate ON and OFF states of operation for the toggle switch 60 as shown. That is, during rotational movement of the switch arm 65, its rectangular cross section tip 66 extends beyond the convention face plate 67 so that the arm 65 can establish the OFF state of operation as shown in FIGS. 2 and 13 or to establish the ON state of operation as shown in FIG. 4 and 14.

Returning to FIG. 2, note that the lockout 10 of the invention is shown in its open position wherein cover frame 19 has been pivoted about transverse pivot axis A—A relative to mounting frame 20 to expose respective interior cavities 3, 4. With regard to the interior cavity 4 of the mounting frame 20, a trio of orthogonally extending openings 5*a*, 5*b* and 5*c* are shown, wherein openings 5*a* and 5*b* are alignable with openings 2 in the switch face plate 67. The opening 5*a* is longitudinally slotted so that the mounting screw 66*a* associated therewith, need not be fully removed. The opening 5*b* is not slotted. Hence the mounting screw 66*a* associated therewith, must be fully removed from the face plate 67 before attachment, as shown. The interior cavity 4 of the mounting frame 20 also includes central aperture 7, previously mentioned, to permit switch arm 65 to penetrate therethrough after the mounting frame 20 is attached via the mounting screws 66*a* as shown in FIG. 13. However, after the cover frame 19 has been pivoted downwardly as shown into nesting contact with the mounting frame 20 as explained below, note that angled surface 68*a* of the switch arm 65 will be placed adjacent to the up-slope surface 43*a* of the up-slope segment 43 of the cover frame 19 as shown in FIG. 13. In such location, as explained below, the up-slope surface 43*a* forms a "stop" so that the toggle switch 60 is "locked out" as to further pivotal switching movement. Hence the OFF operating state of the toggle switch 60 of FIG. 13 is preserved.

In similar fashion with regard to FIG. 4, the ON operating state of the toggle switch 60 can be likewise preserved. Note that the orientation of the lockout 10 is reversed—head—to—toe—from that depicted in FIG. 2. That is, the pivot axis A—A is now located at the lower half of the face plate 67 and the cover frame 19 is pivoted in a upward direction to affect closure relative to the mounting frame 20. In such position as seen in FIG. 14, note that angled surface 68*b* of the switch arm 65 is placed adjacent to the up-slope surface 43*a* of the up-slope segment 43 of the cover frame 19. In such location, as explained below, the up-slope surface 43*a* forms a "stop" so that the toggle switch 60 is "lock out" as to further pivotal switching movement. Hence the ON operating state of the toggle switch 60 of FIG. 14 is preserved.

Figure 16:
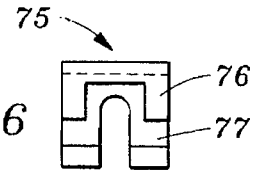
FIGS. 16 and 17 are detail top and side views of the clip of FIG. 15.
Figure 17:
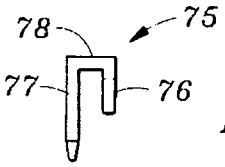
Figure 15:
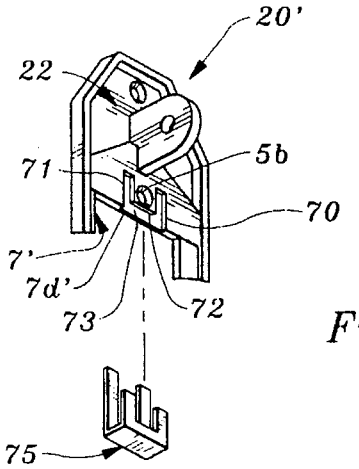
FIG. 15 is a detail of a portion of the cover frame of FIG. 4 at the transverse edge of the central aperture most remote from the pivot axis of the frames in which such transverse edge has been modified to provide elongated slot also located about a 180 degree sector of an orthogonal opening in the end wall, such slot aiding in the attachment of a C-shaped clip relative such slot about such orthogonal opening whereby when the mounting screw is attached therethrough, there is added mechanical stability in association with its usage with the toggle switch there shown.

The lockout 10 of the invention has been previously described in association with FIGS. 1, 3 and 11, 12 and will not be repeated here except to note a modification to the mounting frame as depicted in FIG. 15. As shown, the transverse edge 7*d'* of the aperture 7' of the mounting frame 19' has been modified to include a Cee shaped slot 70 having parallel legs 71, 72 connected by base leg 73. Such orientation fits about half of the orthogonal opening 5*b* and accepts a C-shaped clip 75. As shown in FIGS. 16 and 17, such clip 75 includes parallel legs 76, 77 and base leg 78. The thickness of the longer parallel leg 77 is engineering to match the depth of the counterbore 36 of FIG. 10. Hence, any mounting screws penetrating the opening 5*b* do not cause flexing of the end wall 22 as attachment occurs.

METHOD ASPECTS OF THE INVENTION

Operations of the lockout 10 of the invention, is straight forward. The user removes the mounting screws 16*a*, 66*a* from contact with the switch face plates 9, 67 and attaches the lockout 10 of the invention as depicted in FIGS. 1–4.

Briefly, the steps of the invention, included the following:

(i) establishing one of an OFF and ON operating state for the switch assembly by relating switch arm position of a conventional wall-type electrical rocker or toggle switch assembly, wherein the switch arm projects through an opening in a switch face plate and is pivotable to provide separate operating ON-OFF states about a transversely extending ON-OFF pivot axis, (ii) pivoting the lockout 10 of the present invention to its open position wherein the cover frame 19 is pivoted relative to the mounting plate 20 to expose the interior cavities 3, 4, thereof (iii) positioning the mount frame 20 in contact with the face plate 9, 67 wherein the rear exterior surface 35 of the mounting frame 20 is placed in parallel broad contact with the face plate and wherein the switch arm 15, 65 extends in and through the central aperture 7 formed in the mounting frame 20, the mounting frame 20 also including side and end walls 21, 22 of octagonal shape to form a box-like structure, the end wall 22 also including a trio of orthogonal openings 5*a*, 5*b*, 5*c* at least two of which being alignable with the two orthogonal openings in the face plate 9, 67. The centrally disposed aperture 7 of the mounting frame 20 is rectangular in cross section and includes a series of transverse and longitudinal edges 7*a*, 7*b*, 7*c*, 7*d*, and has an orthogonal axis of symmetry 26 parallel to those of the trio of openings 5*a*, 5*b*, 5*c* alignable with the openings in the face plate 9, 67, (iv) attaching the mounting frame 20 relative to the face plate 9, 67 using mounting screws 16*a*, 66*a* extending through the aligned openings in the face plate so that its counterbore segment 36 can be brought into adjacent pivot-preventing association with switch arm 15 of a rocker switch 11, if such switch is attached to the face plate, (v) pivoting the cover frame 19 relative to the mounting frame 20 about its transverse pivot axis A—A wherein portions of its side wall 37 nest within the cavity 4 of the mounting frame 20 and its end wall 38 is brought into adjacent pivot-preventing association relative to the switch arm of a toggle switch, if such switch is located to the face plate, viz., an up-ramp segment 43 including a up-ramp planar surface 43*a* of the cover frame 19 being positioned n pivot-preventing position relative to the toggle switch arm 65 to thereby provide for a "lock off" state for the switch arm 15, 65 irrespective of ON-OFF operative state of such switch arm.

It has been found that the lockout 10 of the present invention is versatile and may be employed with all toggle and rocker switches of conventional construction presently on the market of which I am aware. In addition, the cover and mounting frames 19, 20 can be integrally formed—separately—by a molding process using a high strength plastic such polycarbonate-ABS and then pivotally united at transverse pivot axis A—A using a pivot bar 80 made of steel or the like, see FIGS. 1–4.

Figure 6:
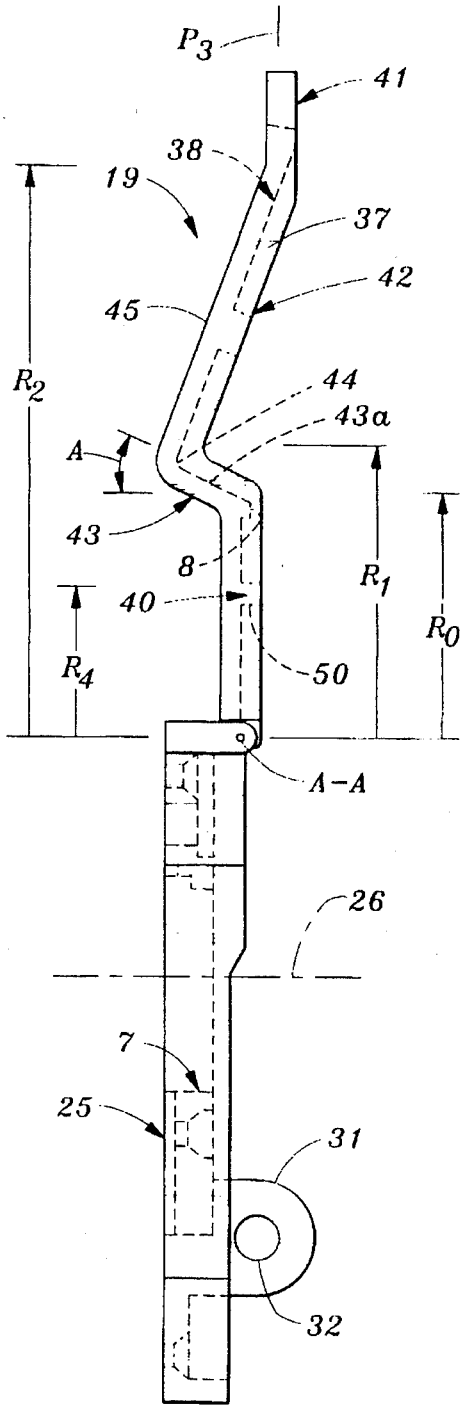
FIG. 6 is a side elevation of the lockout of FIG. 5.

Note in particular response to use with the rocker switch 11 of FIGS. 1, 3, 11 and 12, the following occurs. The integrally formed mounting frame 20 is mounted to the face plate 9 wherein the exterior surface 35 of the end wall 22 is placed in broad surface contact therewith. In such position, the orthogonal axis of symmetry 26 of the aperture 7, see FIGS. 5 and 6, is normal to the face plate 9. And the aperture 7 is sized to received the switch arm 15 including angled surface 15*a* so that the latter can be positioned almost parallel to the switch face plate 9 but convexly oriented thereto. Note further that counterbore segment 36 forms a cavity 36*a*, see FIG. 10, wherein its roof surface 36*d* forms a "stop" for the switch arm 15 as previously mentioned. I.e., roof surface 36*d* forms a "stop" in that its location prevents pivoting of switch arm 15 about the transverse ON-OFF axis B—B. In FIGS. 1 and 11, such positioning preserves the OFF state of operations, while in FIG. 3 and 12, such positioning preserves the ON state of operations.

Note in operations in association with the toggle switch 60 of FIGS. 2 and 4, that the following occurs. In such operations, the mounting frame 20 is mounted to the face plate 67 in broad surface contact with the exterior surface 35 of the end wall 22 of the mounting frame 20. In such position, the orthogonal axis of symmetry 26 of the aperture 7, see FIGS. 5 and 6, is normal to the face plate 67. And the aperture 7 is sized to received the switch arm 65 including angled surfaces 68*a*, 68*b* so that the latter can be positioned almost parallel to the up-slope surface 43*a* of the up-slope segment 43 of the cover frame 19. That is, in the closed position, the cover frame 19 places the up-slope surface 43*a* adjacent to the one of the angled surfaces 68*a*, 68*b* of the switch arm 65. In that way, a "stop" is formed that prevents pivoting of the switch arm 65 about the transverse ON-OFF axis B—B.

While the foregoing embodiments have been set forth in detail, it may be apparent to those skilled in the art that numerous changes be made in such details without departing from the spirit and principles of the invention.

I claim:

1. A switch lockout selectively useable on one of a plurality of conventional wall-type electrical actuators wherein said selected actuator projects through an opening in an associated switch face plate and is pivotable along a path between an on position and an off position wherein a first of said selected actuators being movable in a first predetermined path and a second of said selected actuators being movable in a second predetermined path, comprising an integrally formed, mounting frame adapted to be attached in parallel relationship to said switch face plate and including a side wall of octagonal shape and an end wall having a continuous edge integrally attached to said side wall to form a box-like cavity, said end wall also including a trio of orthogonally extending openings therethrough wherein only two of said openings are used for mounting said mounting frame to said switch face plate, a centrally disposed aperture defined by a series of transverse and longitudinal edges, and a counterbore segment contiguous with said aperture including a receiving cavity of rectangular cross section and a roof surface, said aperture adapted to be alignable with said selected actuator when said mounting frame is attached to said switch face plate, and an integrally formed cover frame pivotally attached to said mounting frame to permit said cover frame to undergo rotation into one of a closed and open position relative to said mounting frame, said cover frame including a side wall of octagonal shape and an end wall integrally attached to said side wall to form a box-like structure, said side wall of said cover being shaped to have a majority portion thereof nesting within said cavity in said mounting frame when said cover is in said closed position, said end wall of said cover frame including first and second end segments and an up-sloping segment located relative to said aperture of said mounting frame whereby pivoting of said selected actuator is prevented by said counterbore segment of said mounting frame intersecting said first predetermined path of said first selected actuator and said up-sloping segment of said cover frame intersecting said second predetermined path of said second selected actuator.

2. The switch lockout of claim 1 in which said mounting and cover frames are formed of plastic.

3. The switch lockout of claim 2 in which said plastic is polycarbonate-ABS.

4. The switch lockout of claim 1 in which said up-slope segment of said cover frame is angled at a first angle relative to a plane parallel to said mounting frame.

5. The switch lockout of claim 4 with the addition of a down-ramp section connected to said up-slope segment and to said second end segment at a second angle which is greater than said first angle.

6. The switch lockout of claim 1 with the addition of a hasp attached to said end wall of said mounting frame and facing outward toward said cover frame, and a slot in said end wall of said cover frame sized to receive said hasp during a closed position of said cover frame relative to said mounting frame.

7. In the prevention of movement of a selected one of a plurality of switch actuators the combination comprising a wall-type switch including a selected actuator pivotable second angle which is greater than said first angle and a face plate through which said selected actuator projects, a first selected actuator being movable in a first predetermined path and a second selected actuator being movable in a second predetermined path, a switch lockout comprising an integrally formed, mounting frame attached in parallel relationship relative to said switch face plate and including a side wall of octagonal shape and an end wall having a continuous edge integrally attached to said side wall to form a box-like cavity, said end wall also including a trio of orthogonally extending openings therethrough wherein only two of said openings are used for mounting said mounting frame to said switch face plate, a centrally disposed aperture defined by a series of transverse and longitudinal edges, and a counterbore segment contiguous with said aperture and including a receiving cavity of rectangular cross section and a roof surface, said aperture alignable with said switch arm when said mounting frame is attached to said switch face plate, and an integrally formed, cover frame pivotally attached to said mounting frame to permit said cover frame to undergo rotation into one of a closed and open position relative to said mounting frame, said cover frame including a side wall of octagonal shape and an end wall integrally attached to said side wall to form a box-like structure, said side wall of said cover being shaped to have a majority portion thereof nesting within said cavity in said mounting frame wherein said cover is in said closed position, said end wall of said cover frame including first and second end segments, and an up-sloping segment located relative to said aperture of said mounting frame whereby pivoting of said selected actuator is prevented by said counterbore segment of said mounting frame intersecting said first predetermined path of said first selected actuator and said up-sloping segment of said cover frame intersecting said second predetermined path of said second selected actuator.

8. The combination of claim 7 in which said mounting and cover frames are formed of plastic.

9. The combination of claim 8 in which said plastic is polycarbonate-ABS.

10. The combination of claim 7 in which said first selected actuator is a rocker switch having an angled planar switch arm wherein a down sloping segment thereof is positioned to abut said roof surface of said receiving cavity of said counterbore segment of said mounting frame to prevent pivoting thereof.

11. The combination of claim 10 in which said receiving cavity defines a rectangular cross section sized to be larger than said angled planar switch arm.

12. The combination of claim 7 in which said second selected actuator is a toggle switch having a switch arm which is rectangular in cross cross section having side surfaces positioned to abut with an up-slope surface of said up-slope segment of said cover frame to prevent pivoting thereof.

13. The combination of claim 7 in which said up-slope segment said cover frame is angled at a first angle relative to a plane parallel to said mounting frame.

14. The combination of claim 13 with the addition of a down-ramp section connected to said up-slope segment and to said second end segment at a second angle which is greater than said first angle.

15. The combination of claim 7 with the addition of a hasp attached to said end wall of said mounting frame and facing outward toward said cover frame, and a slot in said end wall of said cover frame sized to receive said hasp during a closed position of said cover frame relative to said mounting frame.

16. Method of using a wall switch lockout for preventing movement of selected one of a plurality of actuators of a conventional wall-type switch, wherein said selected actuator projects through an opening in an associated switch face plate and is pivotable along a path between an on position and an off position, a first of said actuators being movable in a first predetermined path and a second of said actuators being movable in a second predetermined path comprising the steps of:

(i) establishing one of an OFF and ON position for the switch, (ii) pivoting a cover frame having a side wall and an end wall relative to a mounting frame of a switch lockout to an open operating position, wherein interior cavities in said mounting frame are exposed, (iii) positioning the mounting frame in contact with the face plate of the switch wherein a rear exterior surface of the mounting frame is placed in parallel broad contact with the face plate and wherein the selected actuator of the switch extends into the mounting frame, the mounting frame having an aperture which is contiguous to a counterbore segment in the rear exterior surface of said frame end wall and wherein said counterbore segment has section and a planar roof surface, the mounting frame also including a side wall of octagonal shape to form a box-like structure, and an end wall including a trio of orthogonal openings wherein at least two of said openings being alignable with two orthogonal openings in the face plate, (iv) attaching the mounting frame relative to the face plate using mounting screws that extend through the aligned openings in the face plate so that the counterbore segment at the rear surface of the mounting frame is brought adjacent to the selected actuator, (v) pivoting the cover frame relative to the mounting frame about its transverse pivot axis wherein portions of the cover side wall nest within the mounting frame and the cover end wall is brought into adjacent position relative to the selected actuator whereby a "lock off" state for the switch arm is provided wherein said counterbore segment of said mounting frame intersects said first predetermined path of said first selected actuator and prevents movement thereof and an up-sloping segment of said cover frame intersects said second predetermined path of said second selected actuator and prevents movement thereof.

17. The method of claim 16 in which said first selected actuator is a rocker switch having an angled planar switch arm wherein a down-sloping segment thereof is positioned to abut said roof surface of said receiving cavity of said counterbore segment of said mounting frame to prevent pivoting thereof.

18. The method of claim 17 in which said receiving cavity defines a rectangular cross section sized to be larger than said angled planar switch arm.

19. The method of claim 16 in which said second selected actuator is a toggle switch having a switch arm which is rectangular in cross section having side surfaces positioned to abut with an up-slope surface of said up-slope segment of said cover frame.

20. The method of claim 16 in which said mounting and cover frames are formed of plastic.

* * * * *